United States Patent [19]

Tung

[11] Patent Number: 4,868,724

[45] Date of Patent: Sep. 19, 1989

[54] ELECTRIC TORCH WITH FLEXIBLE CASING

[75] Inventor: Hung-Ying Tung, Kowloon, Hong Kong

[73] Assignee: 3 W Industry Inc., Taiwan

[21] Appl. No.: 316,851

[22] Filed: Feb. 28, 1989

[51] Int. Cl.[4] ..... F21L 7/00

[52] U.S. Cl. ..... 362/189; 362/202; 362/207

[58] Field of Search ..... 362/189, 200, 202, 204, 362/205, 207

[56] References Cited

U.S. PATENT DOCUMENTS

| | | | |
|---|---|---|---|
| 1,397,705 | 11/1921 | Shaw et al. | 362/189 |
| 2,459,702 | 1/1949 | Hipwell et al. | 362/202 |
| 2,553,307 | 5/1951 | Falge | 362/189 |
| 2,729,740 | 1/1956 | Davis | 362/189 |
| 4,286,311 | 8/1981 | Maglica | 362/202 |
| 4,422,131 | 12/1983 | Clanton et al. | 362/189 |

*Primary Examiner*—Ira S. Lazarus
*Assistant Examiner*—Richard R. Cole
*Attorney, Agent, or Firm*—Arnold, White & Durkee

[57] ABSTRACT

An electric torch comprises a collapsible tubular casing made of a fabric material or a leather, a front cover body including a transparent plate, a reflector and a light bulb mounted therein, a substantially tubular connecting member interconnecting the front cover body and the collapsible tubular casing, and an electric circuit means connected with the light bulb and the cells so as to produce light.

4 Claims, 6 Drawing Sheets

ELECTRIC TORCH WITH FLEXIBLE CASING

BACKGROUND OF THE INVENTION

This invention relates to an electric torch, and particularly to an electric torch including a flexible casing made of either a fabric material or a leather.

An object of the invention is to provide an electric torch which is collapsible so that the volume thereof can be reduced to a minimum, thereby facilitating the transportation of the electric torch as well as reducing the cost of the transportation.

SUMMARY OF THE INVENTION

An electric torch includes a collapsible tubular casing made of a fabric material or a leather for receiving cells, a front cover body including a transparent plate, a reflector and a light bulb mounted therein, a substantially tubular connecting member interconnecting the front cover body and the collapsible tubular casing, and an electric circuit means connected with the light bulb and the cells so as to produce light.

The present exemplary preferred embodiments will be described in detail with reference to the accompanying drawings, in which:

DETAILED DESCRIPTION OF THE PREFERRED EMBODIMENTS

Figure 1:
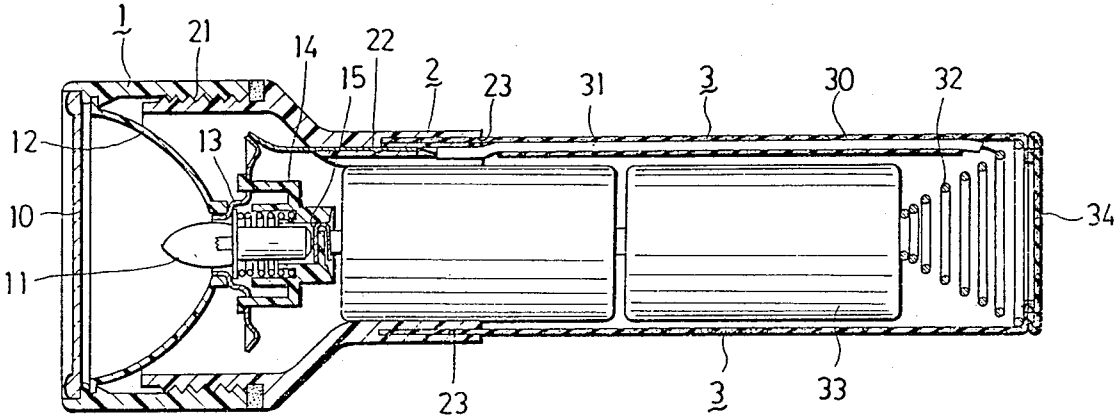
FIG. 1 is a sectional view of a preferred embodiment of the present invention.

Referring to FIG. 1, an electric torch according to the present invention is shown, including a casing which permits batteries to access to the casing through a front cover body 1. The electric torch casing includes a rigid connector 2 and a flexible casing 3 in combination with the front cover body 1. The cover body 1 is conventional and contains a transparent member 10, a reflector 12, a bulb 11, a bulb seat 14, a negatively charged conductor disc 13 and a positively charged spring plate 15. The cover body is connected to the rigid connector 2 by means of a screw thread 21 formed therein.

The rigid connector 2 is a stepped tubular member whose wall is integrally connected with a contact conductor plate 22. When the cover body 1 is screwed to the connector 2, the conductor plate 22 is caused to contact with the conductor disc 13. At the rear portion of the annular wall of the connector 2 is provided an annular groove 23 which receives the front end of the tubular wall of the flexible casing 3. The front end of the flexible casing 3 is fixed to the rigid connector by means of glue.

The flexible casing 3 can be made of a fabric material, a leather or the like. The flexible casing 3 includes a tubular wall 30 and a rear plate member 34. A compression spring 32 is attached to the rear plate member 34 and connected to a conductor 31 which is attached to the tubular wall 30 in a concealed manner and is connected to the contact conductor plate 22. When batteries 33 are inserted into the flexible casing through the front cover body 1, the flexible casing is extended fully and the batteries 33 are clamped tightly between the compression spring 32 and the lamp seat 14. The positive terminal of the battery 33 is normally in contact with the contactor plate 15. When the cover body 1 is turned to a loosened position, the conductor disc 13 and the contact conductor plate 22 are disengaged from one another, thereby turning off the electric circuit of the torch.

Figure 2:
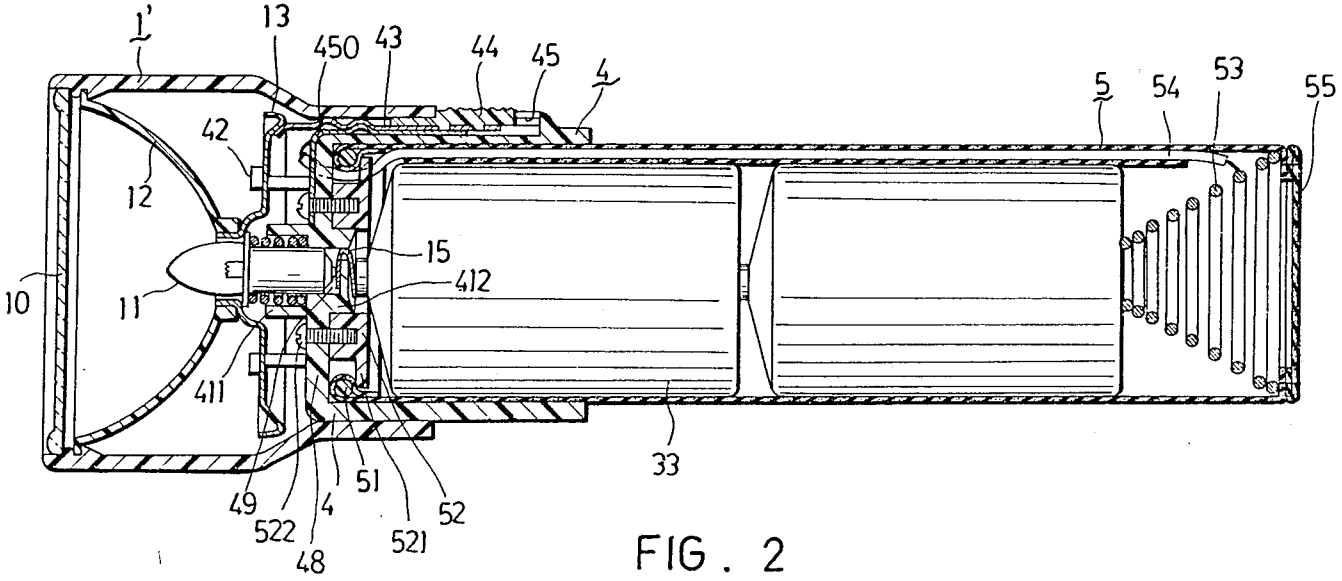
FIG. 2 is a sectional view of a further embodiment of the present invention.
Figure 2A:
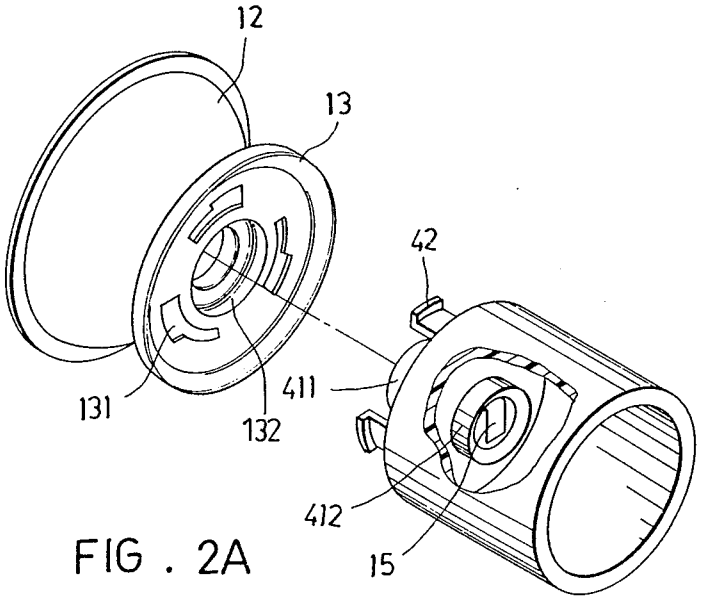
FIG. 2A is an exploded view of the connecting member of the embodiment of FIG. 2.
Figure 3:
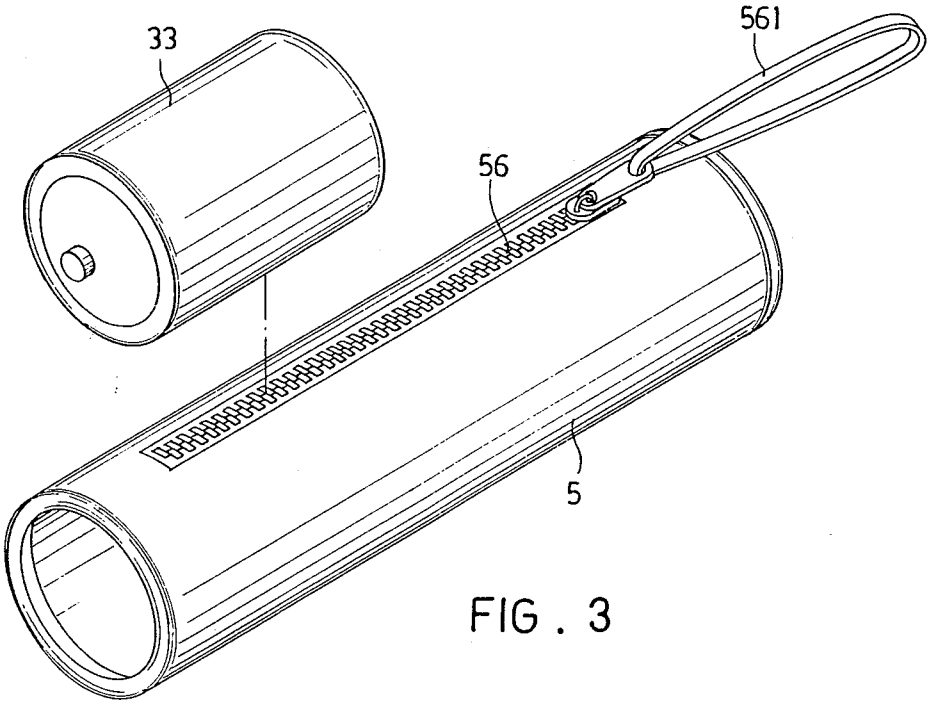
FIG. 3 is a perspective view of the collapsible tubular casing of the embodiment of FIG. 2.

Referring to FIGS. 2, 2A and 3, a second embodiment of the present invention is shown, including a cover body 1', a rigid connecting member 4, and a flexible casing 5. The cover body 1' is conventional and includes a transparent plate 10, a reflector 12, a bulb 11, and a negatively charged conductive disc 13. The conductive disc 13 has a central hole 132 and three lateral slots 131. The rigid connecting member 4 is a tubular member having a front end formed with an annulus-shaped flange 48 which extends radially inward, and forwardly projecting prongs 42 engaging with the slots 131 of the conductive disc 13. The annulus-shaped flange 48 is provided with a forwardly projecting annular boss 411 and a rearwardly projecting annular boss 412 which confine a mounting bore 49 for receiving a bulb holder of the bulb 11.

The outer periphery of the connecting member 4 is provided with a slide recess 45 in which a switch plate 44 is installed. The switch plate 44 is operably connected with a conductive plate 43 which can be moved in or out of contact with the conductive disc 13.

The flexible casing 5 is tubular and formed with an end piece 55. A zipper 56 with a pull member 561 is provided at an access opening of the casing 5 to permit batteries 33 to be inserted into the casing. The annular front end of the flexible casing 5 is folded over a ring member 51 and is clamped against the inner side of the front annular flange 48 by a peripheral portion 521 of a clamping plate 52 which is attached to the flange 48 by means of screws 522. A compression spring 53 attached to the end piece 55 is connected to a conductive plate 450 through a wire 54. The conductive plate 450 is attached to the connecting member 4 and is in contact with the conductive plate 43. A conductive spring plate 15 is placed in the mounting bore 49 and is held therein by the clamping plate 52.

Figure 4:
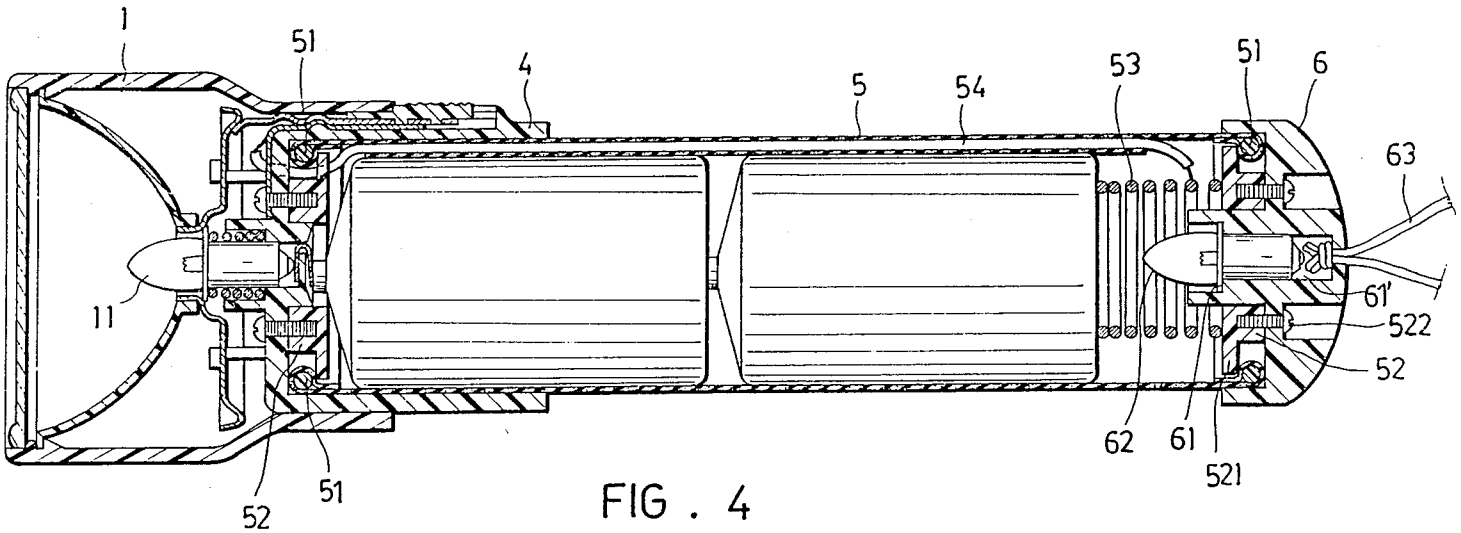
FIG. 4 is a sectional view of a still further embodiment of the present invention.
Figure 5:
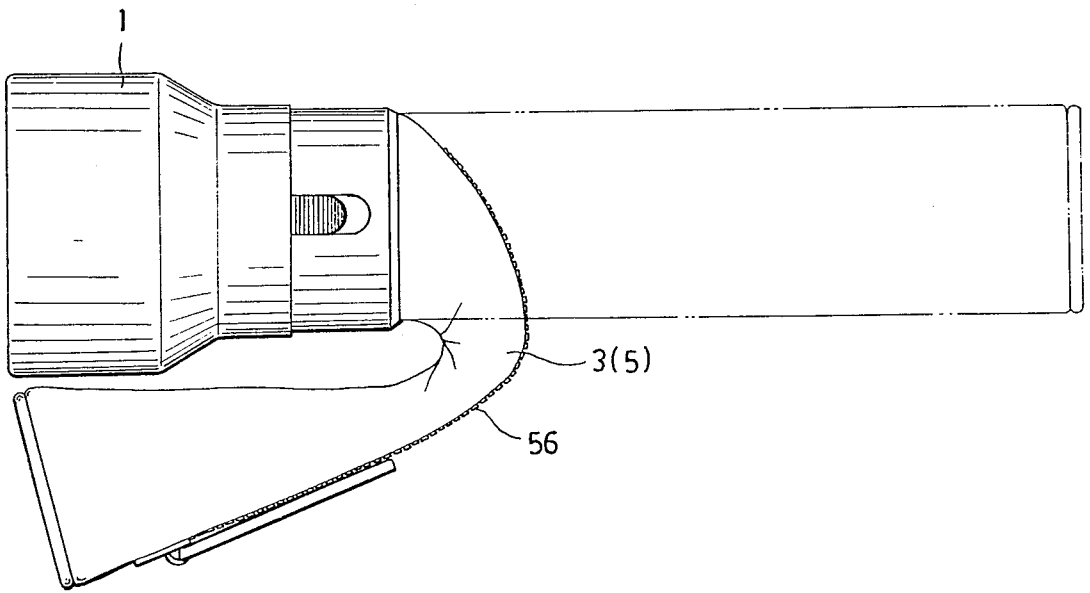
FIG. 5 shows one of the embodiments of the present invention in a collapsed position.

FIG. 4 shows a third embodiment of the invention which is substantially similar to the second embodiment except that the flexible casing 5 has at its rear end a means for holding a replacement light bulb. The means includes a support member 6 and a clamping member 52 which is connected to the rear end of the flexible casing in a manner similar to that in which the front end of the casing 5 is connected to the connecting member 4 as described hereinabove with respect to the second embodiment. The support 6 has an axial cavity 61' and a seat 61 to receive and hold a spare light bulb 62. A cord 63 is attached to the support 6 for hanging and carrying purposes.

With the invention thus explained, it is apparent that various modifications and variations can be made without departing from the scope of the present invention. It is therefore intended that the invention be limited only as indicated in the appended claims.

What I claim is:

1. An electric torch comprising:

a collapsible tubular casing having a closed end and an open end, said casing being made of a material selected from a fabric material and a leather;

a front cover body including a transparent plate, a reflector, and a light bulb mounted therein;

a substantially tubular connecting member connecting said front cover body and said collapsible tubular casing, wherein said tubular connecting member has a front end with an annular flange which extends inwardly, a rear open end, and a clamping plate member adjacent to an inner side of said annular flange, said clamping plate member being fastened to said annular flange and clamping said front open end of said tubular casing against said annular flange; and, an electric circuit means connected with said light bulb so as to produce light.

2. An electric light torch as claimed in claim 1, wherein said collapsed tubular casing further has a ring member around said open end of said collapsible tubular casing, said open end of said collapsible tubular casing being folded back over said ring member, said folded open end and said ring member being clamped by said clamping plate member.

3. An electric torch as claimed in claim 1, wherein said collapsible tubular casing is provided with an axial access opening in a tubular wall thereof and a zipper provided at said access opening.

4. An electric torch as claimed in claim 1, wherein said collapsible tubular casing is provided at said rear end thereof with means for holding a spare bulb, said means including a closing member which forms said closed end of said collapsible tubular casing, said closing member having an axial cavity and a lamp seating member to receive and hold the spare bulb.

* * * * *